United States Patent [19]

Tucker

[11] 4,068,699

[45] Jan. 17, 1978

[54] FIREPLACE CLOSURE

[76] Inventor: Lyndell L. Tucker, 2035 Hickory Creek Drive, Humble, Tex. 77338

[21] Appl. No.: 621,700

[22] Filed: Oct. 14, 1975

[51] Int. Cl.[2] ..... E04F 10/08

[52] U.S. Cl. ..... 160/33; 160/202

[58] Field of Search ..... 49/125, 126, 127; 160/33, 202; 312/341 NR

[56] References Cited

U.S. PATENT DOCUMENTS

| | | | |
|---|---|---|---|
| 315,580 | 4/1885 | Whyman | 49/127 |
| 2,729,287 | 1/1956 | Goldner | 160/33 |
| 2,850,089 | 9/1958 | Burke | 160/202 |
| 3,631,325 | 12/1971 | Wenz | 312/341 NR |

FOREIGN PATENT DOCUMENTS

| | | | |
|---|---|---|---|
| 573,049 | 3/1959 | Canada | 49/127 |

*Primary Examiner*—William H. Schultz
*Attorney, Agent, or Firm*—John E. Reilly

[57] ABSTRACT

Closure of the opening for a fireplace or the like is effected by a plurality of plates or panels which are stored in stacked relation in a housing above the fireplace opening when not in use. The housing includes a biasing arrangement for maintaining pressure against the top of the panel stack so as to urge the panels towards a downwardly opening slot in the rear of the housing. A pair of channel members communicate with the housing slot and are affixed on either side of the opening. The bottom panel of the stack includes an externally accessible handle or the like for sliding this panel into the channels. A series of edge hooks cooperate to serially withdraw the panels from the housing and likewise cooperate to urge the panels serially back into the housing.

3 Claims, 5 Drawing Figures

FIREPLACE CLOSURE

BACKGROUND OF THE INVENTION

The present invention relates to devices for providing temporary closure of an opening in a solid structure. More particularly, the present invention relates to apparatus for removably covering the opening of a fireplace so that the firebox is securely isolated. The present invention is particularly useful for totally closing the opening of a fireplace so that any fire contained within the firebox can be smothered while further insuring that ashes and sparks will not escape from the firebox while the fireplace is unattended.

Despite the development of central heating systems, there has been continuing interest in including fireplaces within buildings, especially residences. This interest was predominantly ornamental but of recent years the value of the fireplace as a supplementary heat source has drawn increased attention. It has long been recognized that the vagaries of the quality of materials being burned requires some form of protective enclosure in order to reduce the prospect of spark escape from the firebox. Thus portable screens have been employed with these screens being replaced in more recent times by permanently attached sliding screens. In some cases, the screen is partially a transparent panel with openings along the bottom to permit ventilation in order to support the fire. An example of a glass screen with counterbalanced panel mountings for permitting access to the firebox is shown in U.S. Pat. No. 2,939,450 by Rubens.

Of necessity, the ventilating openings either through a mesh screen or the ventilating louvers associated with a transparent screen require some communication to the room environment in which the fireplace is located. Such air communication likewise exposes the possibility that spark escape will occur while the fire is burning as is encountered with burning certain types of wood. While the fire is being attended, this hazard is at least somewhat discounted since sparks can usually be promptly extinguished. However, the fireplace often must be left unattended and thus hazard the possibility of spark escape without notice particularly where the fireplace is subject to strong down drafts from the chimney from the wind. Still further, there are frequent occasions when the combustible materials have not been completely consumed and it is preferred to preserve those materials for later use. Even when the fire has burned out, the possibility exists that ashes and dust from the firebox may be blown out of the fireplace by down drafts through the chimney.

One approach in the prior art for providing a secure closure for the fireplace opening is to employ a panel larger than the fireplace opening with spring members for clamping it to the fireplace as suggested in U.S. Pat. No. 3,789,825 by Reiner. Yet another suggested solution is to suspend plates from pulleys and rope or chain attached sash counterweights as shown in U.S. Pat. Nos. 244,397 by Matthews and 579,987 by Jordan. Multiple pivoted plates have also been suggested as in U.S. Pat. No. 2,743,720 by Dollinger while adaptations of multiple sliding panels for window fire guards have been shown in U.S. Pat. Nos. 381,455 by Bennerscheidt, 866,170 by Watson and 1,234,873 by Clampitt.

Despite the various prior art attempts to resolve the problem, none of the presently known protective devices are satisfactory for enclosing the fireplace opening in a manner which both assures the user that no undetected spark and/or ash escape will occur and further that the residual combustibles will be preserved for later use by smothering of the fire.

SUMMARY OF THE INVENTION

The present invention is an enclosure apparatus for temporarily sealing an opening through a solid surface, the primary utility therefor being the protective shielding of the opening of a fireplace. A pair of channel guide members are rigidly attached in parallel relation on opposite sides of the opening with each channel being of a generally U-shaped cross-section with the open edge of these channels being positioned so as to face one another. A multiplicity of flat, rectangular panels provide the actual enclosure and have hook configurations on one edge with the total thickness of these panels including the hook configuration being dimensioned for close but sliding fit within the channels. A housing is positioned above the channels and arranged so as to form a container into which the panels can be inserted in a stacked relation when not in use. An elongated slot along the rear bottom wall of the container communicates with the top opening of the channels so as to accommodate serial movement of the panels out of the container into the channels. A continuous force is applied to the top panel of the stack so as to urge the entire stack towards the rear of the container and thus into alignment with the downwardly opening slot. By gripping an externally accessible handle or the like on the bottom panel of the stack and moving it downward into the channels, the hooked edges engage so as to serially feed the panels into the channels until the opening is securely closed.

Further, by employing angled hook edges or lips for the hook configurations with matching sloped surfaces, the panels can be forced back into the housing slot and interleaved into stacked relation. Thus, with the panels stored in a stack within the housing, the fireplace opening is entirely accessible as heretofore whereas the serial dispensing of these panels into the channels results in an effectively solid enclosing wall for the opening. The entire assembly remains attached in proximity to the opening as an esthetically pleasing appendage to the fireplace and further provides its own storage function when not in use. The invention is capable of economic manufacture but still provides long-term, reliable operation.

An object of this invention is to provide a novel and improved temporary closure for an opening in a solid structure.

Another object of this invention is to provide a closure wall for a fireplace opening in a manner which permits convenient removal of the closure without requiring separate storage facilities.

A further object of this invention is to provide a manually positionable temporary closure for a fireplace opening which accommodates withdrawal of the closure by a simple manual procedure.

Yet another object of this invention is to provide a protective closure for a fireplace opening using a minimum number of components which can be manufactured and installed inexpensively while yielding reliable, long-term operation.

The foregoing and other objects, features and advantages of the present invention will be more readily apparent in view of the following detailed description of an exemplary preferred embodiment.

DETAILED DESCRIPTION OF THE PREFERRED EMBODIMENT

Figure 1:
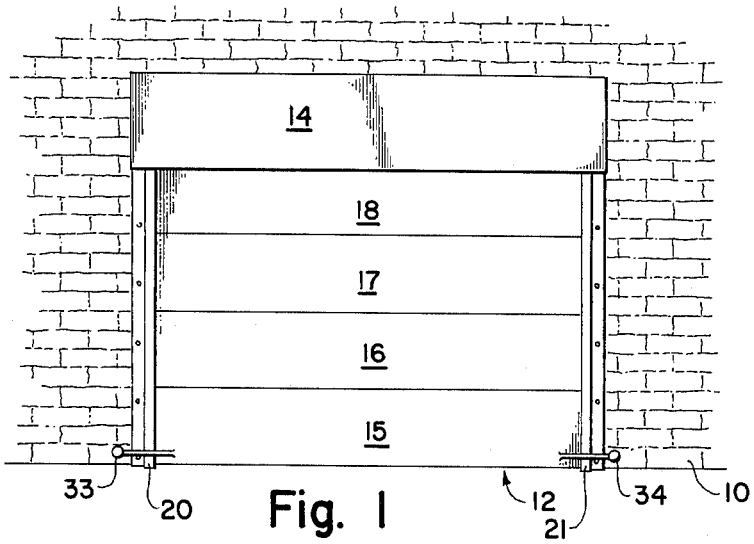
FIG. 1 is a plan view of a fireplace with a typical closure attached thereto in accordance with the present invention.

In FIG. 1, wall 10 has a conventional fireplace opening thereinto with the opening being completely covered by closure assembly 12 in accordance with the preferred embodiment. This closure comprises a container housing 14 and a plurality of panels 15–18 which, as will be understood from the subsequent description can be stacked within container 14 or serially withdrawn therefrom so as to effect the total closure shown in FIG. 1.

Figure 2:
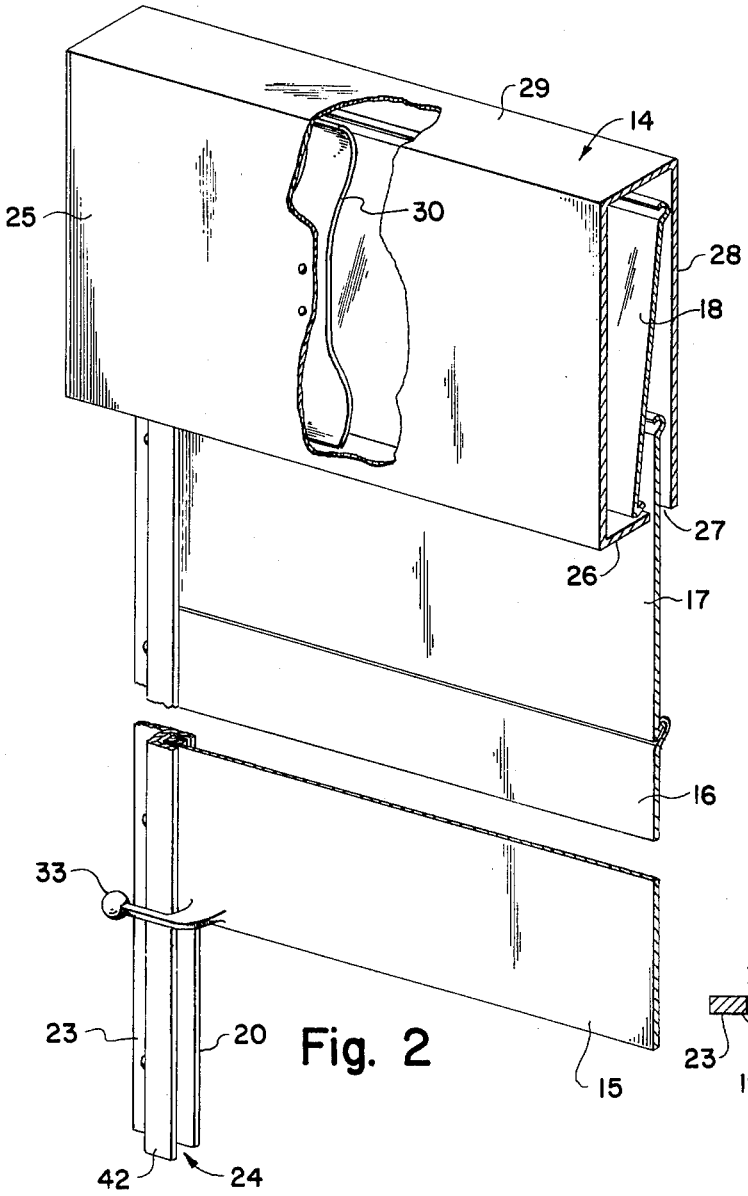
FIG. 2 is a perspective view of a partially broken and partially sectioned portion of the closure apparatus shown in FIG. 1.

A pair of side members 20 and 21 are suitably attached to the face of the wall 10 as by anchor bolts or the like. For instance, suitable holes can be drilled into the face of wall 10 and expansion inserts placed therein for receiving mounting screws such as screw 22 shown in FIG. 5. The attachment of channel beams 20 and 21 as shown on the face of wall 10 enjoys the advantage of placing the entire structure so as to be clear of any internally mounted mesh screen or the like [not shown] while still permitting free movement of panels 15–18 in a vertical plane across the face of the fireplace opening. In any event, beams 20 and 21 have an elongated channel opening such as channel 24 of beam 20 as is evident in FIGS. 2, 4 and 5 with the two channel openings facing one another from opposite sides of the fireplace opening.

Housing 14 is shown as a complete enclosure including front wall 25, bottom wall 26 with an elongated slot 27 extending the length thereof along the rear portion, rear wall 28, top wall 29 and two enclosing end walls [not shown]. For esthetic purposes, all of the exterior walls are preferably solid although rear wall 28 could be other than a solid wall. For instance, the functions of rear wall 28 could be effectively provided by upwardly extending plates from side members 20 and 21, flanges extending from the top wall 29 and/or sidewalls, or could even be in the form of a web as long as it provides appropriate panel guiding functions relative to the channels 20 and 21 and rear slot 27 as will be appreciated from the description.

Figure 4:
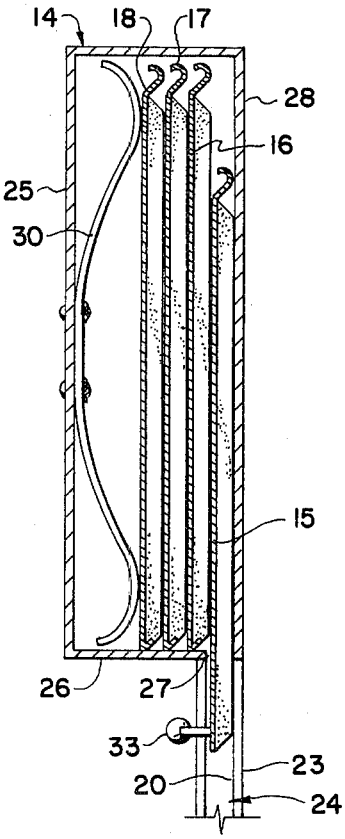
FIG. 4 is a side section view illustrating stacked panels within the housing in accordance with the preferred embodiment.
Figure 5:
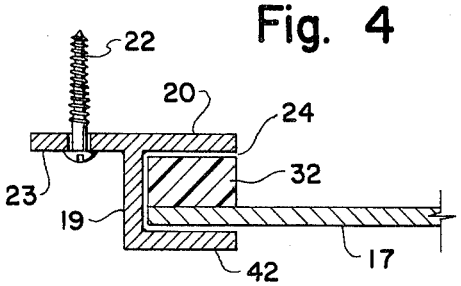
FIG. 5 is a top section view of the engagement of a panel within one channel guide.

As is most clearly evident in FIG. 4, the container defined by housing 14 is dimensioned so as to retain panels 15–18 in stacked relation therein. Further, a pair of leaf springs are preferably positioned in spaced relation within container 14, spring 30 associated with the left side of container 14 being shown in the broken view of FIG. 2 and in the end plan view of FIG. 4. This leaf spring is rigidly attached to front wall 25 and arranged to apply a continuous closure force towards rear wall 28 so as to continuously align the bottom panel of the stack with slot 27. As can be further seen in FIG. 4, slot 27 aligns with the upper open end of the channels for beams 20 and 21, the communication with channel 24 of beam 20 being particularly illustrated.

Housing 14 and beams 20 and 21 are preferably fabricated as separate units which can be disassembled for shipping purposes. Housing 14 is typically attached to wall 10 by any suitable means which as by screw attachments similar to that employed for beams 20 and 21. However, beams 20 and 21 can be continued to the top of container 14 and arranged to receive housing 14. For instance, rear flange 23 and sidewall 19 of channel beams 20 (note FIG. 5) and 21 can be continued upward by the height of housing 14 and include appropriate stubs or shoulders with appropriate bolting hardware to permit attachment of the entire container 14 to the channels as a unit if this should be desired. Under such circumstances, the channel defining front walls such as wall 42 of beam 20 preferably terminates at the bottom wall 26 of container 14. Additionally, the side extension of flange 23 of the channel beams can be omitted and the attaching hardware passed through the interior wall 19 so that channel beams 20 and 21 are attached in inset relation within the fireplace opening if this should be desirable. However, the structure as shown accommodates existing inset mesh screens as mentioned previously. Various expedients for attaching channels 20 and 21 as well as housing 14 in proximity to the fireplace opening will be readily apparent to those having normal skill in the art. Furthermore, the configuration of housing 14 can advantageously provide a mantel or mantel-like structure and/or can be configured as a decorative hood.

Figure 3:
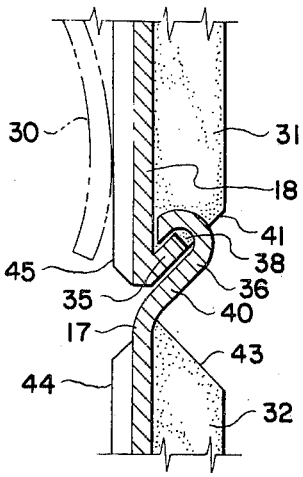
FIG. 3 is a side section view of a typical hook configuration for two panel edges of the FIG. 1 and 2 embodiment.

FIG. 3 illustrates a section view of a portion of panels 17 and 18 particularly illustrating the interlocking and coacting hook arrangement and further illustrating the placement of edge bearing pads or glides 31 and 32. These glides such as 31 and 32 are elongated pads of durable but low sliding friction material such as Teflon or the like which can accommodate the high temperature environment when the fireplace is in use without deformation but still accommodate secure bonding to the rear face of each panel. As can be seen generally in FIG. 4 and particularly in FIG. 5, the total thickness including a glide such as 32 and the panel itself such as 17 is sufficient to permit sliding but close-fitting engagement within the interior of channel 24. By manually grasping externally accessible handles 33 and 34 on the lower edge of the lowermost panel 15, panel 15 can be slid downwardly into the channels. This downward movement of panel 15 and the rearwardly directed bias of the spring means such as 30 causes the next panel to be gripped by the hook edges shown in FIG. 3.

More particularly, FIG. 3 shows a typical lower lip edge 35 for panel 18 which is arranged in an acutely angled relation over the rear face of panel 18 as shown. The upper edge of the preceding panel, panel 17 in FIGS. 2 and 3, includes an outwardly angled J-shaped extension which, as a continuation of the panel surface, first extends at an obtuse angle away from the main body of the panel 17, and then forms a reverse curve engagement hook 36 which defines a groove 38 for receiving lip 35 yet likewise has an angled flat surface 40 for purposes to be described later.

As the lowermost panel 15 of the stack is pulled downwardly through the slot 27 and is about to exit completely through this slot, lower lip 35 of the next panel 16 in the stack is forced into coupling relation by spring 30 and its counterpart spring so that continued downward movement will feed panel 16 into the channels. This hook and lip engaging arrangement on the other end of the suceeding panel edges similarly cooperate until all panels have been pulled down in an apparent solid wall arrangement as shown in FIG. 1. Note that lip and hook arrangements extending continuously across appropriate upper and lower edges of panels 15–18 are generally preferable to insure relatively complete closure of the fireplace opening. However, it will be readily recognized that less than full edge extensions can be used such as by including two or more spaced lip 35 and hook 36 segments on the panel edges.

The flat portion 40 of J-hook 36 likewise cooperates with lip 35 when the panels are being returned to the housing 14. That is, because of the restraint from the channels and the engaging surfaces between lip 35 and flat portion 40 of hook edge 36, upward movement of lower panel 15 will cause all panels to move upwardly, the lips and hooks disengaging upon entry through slot 27 and the angled surfaces of the lip and hook edges and further in conjunction with sloped edges of the pads (e.g.: sloped surfaces 41 and 43 in FIG. 3) cooperatively forcing the panels into stacked relation such as shown in FIG. 4.

FIG. 3 illustrates a potential modification which may be useful in some circumstances. More particularly, FIG. 3 shows a pair of additional glide pads 44 and 45 which are bonded to the opposite faces or flat surface portions of panels 17 and 18 respectively. In addition to reducing friction, such additional pads can further reduce the possibility of galvanic action in the event that different materials are used for panels and channels such as aluminum guide channels and steel panels or vice versa. Yet another advantage from using additional glide pads 44 and 45 is that they can be positioned so as to receive the direct bearing pressure from the leaf springs, the end of leaf springs 30 being shown as pressuring the surface of pad 45 in FIG. 3, thereby preventing any scratching or scoring of the front surface of the top panel in the stack while it is being slid out from under the springs.

Prevention of scratching of the topmost panel 18 in the stack when it is slid out from under spring 30 can also be accomplished by including an extra panel which is not actually fed out of housing 14. Further, the springs such as 30 can be positioned at the extreme ends just above the channels so that any scratch marks thereon will be disguised by the channels. In any event, the additional pads such as 44 and 45 are preferably positioned so that they likewise are fed into the channels. Thus the total thickness of the panels such as panel 17 with rear glide 32 and supplementary front glides 44 attached is dimensioned for fitting within the open channel such as 24 in a closely fitting but sliding relationship.

Note that the walls of container 14 can be extended downwardly so as to disguise the existence of manually accessible handles 33 and 34. Furthermore, the present invention can be easily constructed so as to accommodate curved fireplace openings as are employed in some fireplace structures. The catch lip and hook configuration could be reversed so as to extend outwardly instead of having the orientation shown but, for esthetic purposes, it is generally preferred that these extensions be rearward as depicted and thus not visible from the front of the closed panel configuration.

The panels can be of any suitable sheet material but are preferably fabricated from steel, anodized aluminum, copper, bronze or other metal. Furthermore, the panels including the flat surfaces, pads, edge lips and hooks can be cast or molded as a single unit of any material as long as it has sufficient strength for its intended usage and can withstand the temperatures of the fireplace environment. In a typical configuration, the panels 15–18 are 1/32 inch steel or anodized aluminum with a vertical heighth of 6 to 8 inches and a horizontal length of 38 to 50 inches to accommodate most standard fireplace structure. The channel guides 20 and 21 are cast aluminum and the bearing glides bonded thereon are of Teflon. The biasing springs such as 30 are preferably bowed spring steel in the configuration as shown which is advantageous in that it maintains constant closure pressure towards the rear wall 28 at both the upper and lower edges of the panel stack. However, various biasing arrangements can be used in place of the bow springs.

Although the present invention has been described with particularity relative to the foregoing detailed description of an exemplary preferred embodiment, various changes, modifications, additions and applications other than those specifically mentioned herein will be readily apparent to those having normal skill in the art without departing from the spirit of this invention.

What is claimed is:

1. In apparatus adapted for providing a temporary enclosure for an opening through a fireplace and the like wherein a pair of U-shaped guides are positioned in upright, facing, parallel relation to one another on opposite sides of the fireplace opening, and a panel-receiving housing having front, rear and bottom walls disposed horizontally above the channel guides and adapted for receiving panels in stacked relation and for dispensing the same through a slot in the bottom wall which is aligned in communication with the channel guides, the improvement comprising:

a plurality of substantially flat, rectangular, fire-resistant panels, each said panel having an upper and a lower horizontal edge, each said upper horizontal edge formed to cooperatively engage the lower horizontal edge of an adjacent panel wherein one edge includes an acutely angled, flat return lip projecting over the surface of its associated panel and wherein the horizontal edge of the adjacent panel is formed as a hooked portion of the associated said panel and projecting first obtusely away from the associated said panel and terminating in a reverse curved portion, the end of said reverse curved portion substantially returning to the plane of the associated said panel for releasably engaging said flat return lip;

force applying means for yieldingly urging said panels within said housing successively into alignment with said slot;

means for serially advancing said panels successively from the stack along said guide means, said panel edges being arranged such that said one edge of each said panel in succession receives said other edge of each next said panel in the stack as said panels are serially advanced through said housing slot into said guide means whereby said panels are urged into coplanar relation to one another to form a common closure across the opening between said guide means, allowing coplanar orientation of said panels within the channel guides; and vertical channel-engaging edges on said flat panels including slide bearing means projecting in a lateral direction from said vertical channel-engaging edges for a distance sufficient to prevent said reverse curved portions and said hooked portions from contacting said channel guides as they are serially advanced along said channel guides.

2. In apparatus in accordance with claim 1 wherein each said panel has a second pair of slide bearing means attached thereto along the respective edges thereof which enter said channel guides opposite the panel surface which the first-mentioned pair of slide bearings is attached.

3. In apparatus in accordance with claim 1 wherein said flat return lip and said hooked portion are formed as continuations of and with the same thickness as said panels.

* * * * *